US011267003B2

(12) United States Patent
Vogel et al.

(10) Patent No.: US 11,267,003 B2
(45) **Date of Patent: *Mar. 8, 2022**

(54) POWER SPRAYER

(71) Applicant: Delta Faucet Company, Indianapolis, IN (US)

(72) Inventors: John David Vogel, Columbus, IN (US); Michael Scot Rosko, Greenwood, IN (US); Patrick B. Jonte, Zionsville, IN (US); Ryan Anthony Reeder, Carmel, IN (US)

(73) Assignee: Delta Faucet Company, Indianapolis, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/971,071

(22) Filed: May 4, 2018

(65) Prior Publication Data

US 2018/0250693 A1 Sep. 6, 2018

Related U.S. Application Data

(63) Continuation of application No. 12/965,207, filed on Dec. 10, 2010, now Pat. No. 9,962,718, which is a (Continued)

(51) Int. Cl.
*B05B 1/34* (2006.01)
*B05B 1/06* (2006.01)
(Continued)

(52) U.S. Cl.
CPC ..... *B05B 1/3463* (2013.01); *B05B 1/06* (2013.01); *B05B 1/10* (2013.01); *B05B 1/12* (2013.01);
(Continued)

(58) Field of Classification Search
CPC .... B05B 1/06; B05B 1/10; B05B 1/12; B05B 1/14; B05B 1/3402; B05B 1/3436; B05B 1/16; B67D 1/1444; Y10T 137/87402
See application file for complete search history.

(56) References Cited

U.S. PATENT DOCUMENTS 544,122 A 8/1895 Rigby
603,144 A 4/1898 Kellerman et al.
(Continued)

FOREIGN PATENT DOCUMENTS

CN 101180132 A 5/2008
CN 104043543 A 9/2014
(Continued)

OTHER PUBLICATIONS

NEOPERL® Product Faucet Aerators, undated, 1 pg.
(Continued)

*Primary Examiner* — Steven M Cernoch
(74) *Attorney, Agent, or Firm* — Bose McKinney & Evans LLP

(57) ABSTRACT

A spray head for a power sprayer configured to generate a continuous sheet-like water shield around a center stream of water is disclosed. A water delivery device for use with a sink is disclosed, the water delivery device may produce a stream of water surrounded by a continuous shield of water.

20 Claims, 18 Drawing Sheets

Related U.S. Application Data continuation of application No. 11/383,267, filed on May 15, 2006, now Pat. No. 7,850,098.

(60) Provisional application No. 60/680,939, filed on May 13, 2005.

(51) Int. Cl.

| | |
|---|---|
| ***B05B 1/10*** | (2006.01) |
| ***B05B 1/12*** | (2006.01) |
| ***B05B 1/14*** | (2006.01) |
| *B05B 1/16* | (2006.01) |

(52) U.S. Cl.

CPC ..... *B05B 1/14* (2013.01); *B05B 1/3402* (2018.08); *B05B 1/3436* (2013.01); *B05B 1/16* (2013.01); *B05B 1/3431* (2013.01)

(56) References Cited

U.S. PATENT DOCUMENTS 625,466 A 5/1899 Randolph
1,118,118 A 11/1914 Fischer
1,123,189 A 12/1914 Hannaford
1,254,748 A 1/1918 Weidlich
1,647,983 A 11/1927 Bloch
2,127,188 A 8/1938 Schellin et al.
2,217,188 A 10/1940 Gerson
2,307,014 A 1/1943 Becker et al.
2,313,994 A 3/1943 Grant
2,314,071 A 3/1943 Bucknell et al.
2,331,741 A 10/1943 Smith
2,416,737 A 3/1947 Budan
2,416,747 A 3/1947 Geimer
2,531,789 A 11/1950 Rowley
2,543,390 A * 2/1951 Van Vliet ..... B67D 1/1444 137/600
2,550,573 A * 4/1951 Lyman ..... F24F 6/12 239/468
2,566,878 A 9/1951 Fahrenkrog et al.
2,567,176 A 9/1951 Ballard
2,584,943 A 2/1952 Thomas
2,842,154 A 7/1958 Lindsley
2,878,006 A 3/1959 Brougham et al.
2,878,066 A 3/1959 Erwin
2,956,579 A 10/1960 Carvel et al.
3,022,015 A 2/1962 Burch
3,144,878 A 8/1964 Williams
3,207,443 A 9/1965 Gilmour
3,286,935 A 11/1966 Corlett
3,337,134 A 8/1967 Bond
3,341,132 A 9/1967 Parkison
3,485,451 A 12/1969 Gore et al.
3,524,591 A 8/1970 Samuels et al.
3,545,473 A 12/1970 Mola
3,554,451 A 1/1971 Aghnides
3,588,040 A 6/1971 Ward
3,591,083 A 7/1971 O'Rear
3,656,503 A 4/1972 Ward
3,682,392 A 8/1972 Kint
3,685,541 A 8/1972 Caparone et al.
3,698,644 A 10/1972 Nystuen
3,722,525 A 3/1973 Epple
3,722,798 A 3/1973 Bletcher et al.
3,730,440 A 5/1973 Parkison
3,768,735 A 10/1973 Ward
3,786,995 A 1/1974 Manoogian et al.
3,851,825 A 12/1974 Parkison et al.
3,880,354 A * 4/1975 Van Horn ..... B23K 7/08 239/132.3
3,902,671 A 9/1975 Symmons
3,944,141 A 3/1976 Siczek
4,026,471 A * 5/1977 Hunter ..... B05B 15/70 239/206
4,029,119 A 6/1977 Klieves
4,052,002 A 10/1977 Stouffer et al.
4,078,726 A 3/1978 Walto
4,119,276 A 10/1978 Nelson
4,128,206 A 12/1978 Bintner
4,132,362 A 1/1979 Hyde et al.
4,145,004 A 3/1979 Krizik
4,187,986 A 2/1980 Petrovic
4,221,337 A 9/1980 Shames et al.
4,224,962 A 9/1980 Orszullok
4,257,460 A 3/1981 Paranay et al.
4,346,844 A 8/1982 Harmony
4,396,156 A 8/1983 Southworth et al.
4,398,669 A 8/1983 Fienhold
4,421,269 A 12/1983 Ts'ao
4,461,052 A 7/1984 Mostul
4,470,546 A 9/1984 Wildfang
4,516,753 A 5/1985 Thomsen
4,524,911 A 6/1985 Roznieckі
4,534,512 A 8/1985 Chow et al.
4,534,513 A 8/1985 Aghnides
4,534,514 A 8/1985 Aghnides
4,537,360 A 8/1985 Bock
4,541,568 A 9/1985 Lichfield
4,570,860 A 2/1986 Aprea et al.
4,581,707 A 4/1986 Millar
4,582,253 A 4/1986 Gerdes
4,606,370 A 8/1986 Geipel et al.
4,618,100 A 10/1986 White et al.
4,619,403 A 10/1986 Goldney et al.
4,629,124 A 12/1986 Gruber
4,637,552 A 1/1987 Finkbeiner
4,650,120 A 3/1987 Kress
4,653,693 A 3/1987 Steingass
4,657,185 A 4/1987 Rundzaitis
4,666,085 A 5/1987 Liaw
4,682,728 A 7/1987 Oudenhoven et al.
4,696,322 A 9/1987 Knapp et al.
4,700,884 A 10/1987 Barrett et al.
4,703,893 A 11/1987 Gruber
4,712,591 A 12/1987 McCann et al.
4,776,517 A 10/1988 Heren
4,785,998 A 11/1988 Takagi
4,789,103 A 12/1988 Ruhnke
4,795,092 A 1/1989 Fuller
4,796,815 A 1/1989 Greenberg
4,823,409 A 4/1989 Gaffney et al.
4,830,280 A 5/1989 Yankoff
RE32,981 E 7/1989 Marty
4,854,498 A 8/1989 Stayton
4,854,545 A 8/1989 Pezzarossi
4,869,287 A 9/1989 Pepper et al.
4,869,427 A 9/1989 Kawamoto et al.
4,886,210 A 12/1989 Gaffney et al.
4,893,653 A 1/1990 Ferrigno
4,909,443 A 3/1990 Takagi
4,923,116 A 5/1990 Homan
4,927,115 A 5/1990 Bahroos et al.
4,934,402 A 6/1990 Tarnay et al.
4,945,943 A 8/1990 Cogger
4,955,546 A 9/1990 Liaw
4,986,475 A 1/1991 Spadafora et al.
4,997,131 A 3/1991 Heren
5,014,919 A 5/1991 Knapp
5,040,106 A 8/1991 Maag
5,052,587 A 10/1991 Graves
5,069,241 A 12/1991 Hochstrasser
5,093,943 A 3/1992 Wei
5,100,055 A 3/1992 Rokitenetz et al.
5,100,058 A 3/1992 Wei
5,111,994 A 5/1992 Gonzalez
5,124,934 A 6/1992 Kawamoto et al.
5,143,295 A 9/1992 Okayama
5,143,299 A 9/1992 Simonetti et al.
5,145,114 A 9/1992 Monch
5,148,824 A 9/1992 Wilson et al.
5,158,234 A 10/1992 Magnenat et al.
5,160,086 A 11/1992 Kuykendal et al.
5,160,092 A 11/1992 Rose et al.
5,170,361 A 12/1992 Reed

(56) References Cited

U.S. PATENT DOCUMENTS 5,170,816 A 12/1992 Schnieders
5,172,866 A 12/1992 Ward
5,184,777 A 2/1993 Magnenat et al.
5,201,468 A 4/1993 Freier et al.
5,232,162 A 8/1993 Chih
5,242,119 A 9/1993 Jariyasunant
5,255,848 A 10/1993 Rhodehouse
5,256,287 A 10/1993 Underwood
5,287,570 A 2/1994 Peterson et al.
5,323,968 A 6/1994 Kingston et al.
5,333,792 A 8/1994 Wang
5,348,228 A 9/1994 Wang
5,348,231 A 9/1994 Arnold et al.
5,370,314 A 12/1994 Gebauer et al.
5,383,604 A 1/1995 Boesch
5,398,872 A 3/1995 Joubran
5,433,384 A 7/1995 Chan et al.
5,445,182 A 8/1995 Sturman et al.
5,467,927 A 11/1995 Lee
5,467,929 A 11/1995 Bosio
5,467,967 A 11/1995 Gillooly
5,477,885 A 12/1995 Knapp
5,486,383 A 1/1996 Nowotarski et al.
5,507,314 A 4/1996 Knapp
5,542,449 A 8/1996 Huang
5,551,635 A 9/1996 Jager
5,630,548 A 5/1997 Chih
5,634,220 A 6/1997 Chiu
5,641,120 A 6/1997 Kuykendal et al.
5,647,537 A 7/1997 Bergmann
5,649,562 A 7/1997 Sturman et al.
5,662,273 A 9/1997 Chih
5,662,276 A 9/1997 Ko
5,669,558 A 9/1997 Ichel
5,707,011 A 1/1998 Bosio
5,722,597 A 3/1998 Guo
5,732,884 A 3/1998 Jauner
5,735,467 A 4/1998 Lee
5,743,286 A 4/1998 Ko
5,772,120 A 6/1998 Huber
5,794,854 A 8/1998 Yie
5,806,770 A 9/1998 Wang
5,806,771 A 9/1998 Loschelder et al.
5,813,435 A 9/1998 Knapp
5,823,229 A 10/1998 Bertrand et al.
5,829,681 A 11/1998 Hamel et al.
5,853,130 A 12/1998 Ellsworth
5,858,215 A 1/1999 Burchard et al.
5,873,531 A 2/1999 Wang
5,873,647 A 2/1999 Kurtz et al.
5,887,796 A 3/1999 Dimmer
5,889,684 A 3/1999 Ben-David et al.
5,906,319 A 5/1999 Crowl
5,918,816 A 7/1999 Huber
5,927,333 A 7/1999 Grassberger
5,937,905 A 8/1999 Santos
5,944,141 A 8/1999 Kochan et al.
5,971,299 A 10/1999 Loschelder et al.
5,975,429 A 11/1999 Jezek
5,975,432 A 11/1999 Han
5,979,776 A 11/1999 Williams
5,984,207 A 11/1999 Wang
6,000,626 A 12/1999 Futo et al.
6,000,637 A 12/1999 Duncan
6,003,170 A 12/1999 Humpert et al.
6,007,003 A 12/1999 Wang
6,016,975 A 1/2000 Amaduzzi
6,019,130 A 2/2000 Rump
6,029,094 A 2/2000 Diffut
6,039,269 A 3/2000 Mandzukic
6,045,062 A 4/2000 Bosio
6,048,181 A 4/2000 Chang
6,058,971 A 5/2000 Palmer et al.
6,059,200 A 5/2000 Chou
6,076,743 A 6/2000 Fan
6,085,790 A 7/2000 Humpert et al.
6,129,294 A 10/2000 Hsin-Fa
6,145,757 A 11/2000 Knapp
6,151,729 A 11/2000 Yean
6,158,152 A 12/2000 Nathenson et al.
6,164,566 A 12/2000 Hui-Chen
6,173,910 B1 1/2001 Yean
6,173,911 B1 1/2001 Hui-Chen
6,179,130 B1 1/2001 Nguyen et al.
6,216,965 B1 4/2001 Chao
6,220,297 B1 4/2001 Marty et al.
6,230,989 B1 5/2001 Haveistaw et al.
6,234,192 B1 5/2001 Esche et al.
6,247,654 B1 6/2001 Kuo
6,250,570 B1 6/2001 Starr et al.
D445,874 S 7/2001 Czerwinski, Jr. et al.
6,254,016 B1 7/2001 Chao
6,260,772 B1 7/2001 Hennemann, Jr. et al.
6,260,774 B1 7/2001 Erickson
6,290,147 B1 9/2001 Bertrand et al.
6,290,149 B1 9/2001 Daniel et al.
6,296,011 B1 10/2001 Esche et al.
6,302,339 B1 10/2001 Chou
6,305,619 B1 10/2001 Thurn
6,315,208 B1 11/2001 Doyle
6,341,389 B2 1/2002 Philipps-Liebich et al.
6,341,738 B1 1/2002 Coles
6,367,710 B2 4/2002 Fan
6,367,711 B1 4/2002 Benoist
6,368,503 B1 4/2002 Williamson et al.
6,370,713 B2 4/2002 Bosio
6,382,529 B1 5/2002 Wu
6,415,958 B1 7/2002 Donley
6,427,931 B1 8/2002 Guo
6,431,468 B1 8/2002 Brown et al.
6,446,875 B1 9/2002 Brooks et al.
6,454,186 B2 9/2002 Haveistaw et al.
6,454,187 B1 9/2002 Wang
6,460,782 B1 10/2002 Wang
6,467,104 B1 10/2002 Shieh
6,471,141 B2 10/2002 Smith et al.
6,471,146 B1 10/2002 Kuykendal et al.
6,484,953 B2 11/2002 Freier
6,502,768 B2 1/2003 Chang
6,508,415 B2 1/2003 Wang
6,513,787 B1 2/2003 Jeromson et al.
6,520,427 B1 2/2003 Chen
RE38,013 E 3/2003 Stouffer
6,540,159 B1 4/2003 Wang
6,540,163 B1 4/2003 Huang
6,561,210 B2 5/2003 Hsieh et al.
6,561,439 B1 5/2003 Bonzer
6,561,441 B1 5/2003 Hsieh
6,568,605 B1 5/2003 Chen
6,575,196 B1 6/2003 Creswell
6,575,387 B1 6/2003 Baker
6,592,057 B1 7/2003 Ericksen et al.
6,595,440 B2 7/2003 Moriarity et al.
6,612,507 B1 9/2003 Meyer et al.
6,622,945 B1 9/2003 Wu et al.
6,629,645 B2 10/2003 Mountford et al.
6,631,525 B2 10/2003 Piatt et al.
6,634,573 B2 10/2003 Boesch et al.
6,641,060 B2 11/2003 Brattoli et al.
6,641,061 B1 11/2003 Hsieh
6,644,333 B2 11/2003 Gloodt
6,659,373 B1 12/2003 Heren et al.
6,663,022 B1 12/2003 Baker
6,685,110 B2 2/2004 Wang et al.
6,691,933 B1 2/2004 Bosio
6,691,937 B2 2/2004 Heren et al.
6,694,544 B2 2/2004 Piatt et al.
6,705,534 B1 3/2004 Mueller
6,705,549 B2 3/2004 Nakamure
6,715,699 B1 4/2004 Greenberg et al.
6,719,219 B1 4/2004 Wang
6,730,177 B1 5/2004 Talley et al.
6,738,996 B1 5/2004 Malek et al.
6,739,523 B2 5/2004 Haveistaw et al.

(56) References Cited

U.S. PATENT DOCUMENTS

| | | | |
|---|---|---|---|
| 6,749,135 | B2 | 6/2004 | Groblebe et al. |
| 6,757,921 | B2 | 7/2004 | Esche |
| 6,766,864 | B2 | 7/2004 | Clauss et al. |
| 6,786,240 | B2 | 9/2004 | Ouyoung |
| 6,796,515 | B2 | 9/2004 | Heren et al. |
| 6,808,130 | B1 | 10/2004 | Ouyoung |
| 6,808,131 | B2 | 10/2004 | Bosio |
| 6,811,099 | B2 | 11/2004 | Stine et al. |
| 6,860,438 | B1 | 3/2005 | Huang |
| 6,866,208 | B2 | 3/2005 | Kao |
| 6,879,863 | B2 | 4/2005 | Mueller et al. |
| 6,880,768 | B2 | 4/2005 | Lau |
| 6,915,967 | B1 | 7/2005 | Chen |
| 6,921,032 | B2 | 7/2005 | Habermacher et al. |
| 6,945,474 | B1 | 9/2005 | Chen |
| 6,962,298 | B1 | 11/2005 | Martin |
| 6,964,404 | B2 | 11/2005 | Patterson et al. |
| 6,964,405 | B2 | 11/2005 | Marcichow et al. |
| 6,971,591 | B2 | 12/2005 | Fleischmann |
| 6,981,661 | B1 | 1/2006 | Chen |
| 7,000,266 | B2 | 2/2006 | Piatt et al. |
| 7,000,626 | B1 | 2/2006 | Cress |
| 7,000,854 | B2 | 2/2006 | Malek et al. |
| 7,661,609 | B2 | 2/2010 | Dexter et al. |
| 7,850,098 | B2 * | 12/2010 | Vogel ..... B05B 1/06 239/463 |
| 8,424,781 | B2 | 4/2013 | Rosko et al. |
| 8,579,213 | B2 | 11/2013 | Myers |
| 9,962,718 | B2 | 5/2018 | Vogel et al. |
| 2001/0020302 | A1 | 9/2001 | Bosio |
| 2002/0104906 | A1 | 8/2002 | Freier |
| 2002/0185553 | A1 | 12/2002 | Benstead et al. |
| 2002/0190141 | A1 | 12/2002 | Huang |
| 2003/0042331 | A1 | 3/2003 | Lu |
| 2003/0042337 | A1 | 3/2003 | Liang et al. |
| 2003/0080213 | A1 | 5/2003 | Clauss |
| 2003/0125842 | A1 | 7/2003 | Chang et al. |
| 2003/0127541 | A1 | 7/2003 | Marino |
| 2003/0178857 | A1 | 8/2003 | Roman |
| 2003/0164415 | A1 | 9/2003 | Mitchell |
| 2003/0173423 | A1 | 9/2003 | Haenlein et al. |
| 2003/0189111 | A1 | 10/2003 | Heren et al. |
| 2004/0010848 | A1 | 1/2004 | Esche |
| 2004/0060308 | A1 | 4/2004 | Yoshizawa et al. |
| 2004/0074543 | A1 | 4/2004 | Dickson et al. |
| 2004/0088786 | A1 | 5/2004 | Malek et al. |
| 2004/0112985 | A1 | 6/2004 | Malek et al. |
| 2004/0155460 | A1 | 8/2004 | Nobili |
| 2004/0164183 | A1 | 8/2004 | Nobili |
| 2004/0173688 | A1 | 9/2004 | Gloodt |
| 2004/0222320 | A1 | 11/2004 | Wu |
| 2004/0227014 | A1 | 11/2004 | Williams et al. |
| 2004/0227016 | A1 | 11/2004 | Yagi et al. |
| 2005/0072866 | A1 | 4/2005 | Petit |
| 2005/0103897 | A1 | 5/2005 | Cannon et al. |
| 2005/0121542 | A1 | 6/2005 | Su Lim |
| 2005/0145554 | A1 | 7/2005 | Cunningham et al. |
| 2005/0161533 | A1 | 7/2005 | Nobili |
| 2005/0178857 | A1 | 8/2005 | Roman |
| 2005/0178858 | A1 | 8/2005 | Roman |
| 2005/0189438 | A1 | 9/2005 | Bosio |
| 2005/0204462 | A1 | 9/2005 | Cotton et al. |
| 2005/0242210 | A1 | 11/2005 | Heren et al. |
| 2006/0016912 | A1 | 1/2006 | Nobili |
| 2006/0022071 | A1 | 2/2006 | Bumworth et al. |
| 2006/0117477 | A1 | 6/2006 | Rosko |
| 2006/0214016 | A1 | 9/2006 | Erdely et al. |
| 2006/0255167 | A1 | 11/2006 | Vogel et al. |
| 2008/0067264 | A1 | 3/2008 | Erickson et al. |
| 2008/0105764 | A1 | 5/2008 | Jianglin et al. |
| 2016/0228891 | A1 | 8/2016 | Rosko et al. |
| 2020/0129996 | A1 | 4/2020 | Rosko et al. |

FOREIGN PATENT DOCUMENTS

| | | | |
|---|---|---|---|
| CN | 204544496 | U | 8/2015 |
| DE | 3306947 | | 8/1984 |
| DE | 3643320 | | 7/1988 |
| EP | 0251990 | | 7/1988 |
| EP | 0337367 | A2 | 10/1989 |
| EP | 0933136 | | 8/1999 |
| EP | 1132141 | | 9/2001 |
| EP | 0809539 | | 5/2003 |
| EP | 1354634 | | 10/2003 |
| EP | 1418007 | | 5/2004 |
| EP | 0975432 | | 11/2005 |
| EP | 1598116 | | 11/2005 |
| GB | 1452974 | | 10/1976 |
| GB | 1555003 | A | 11/1979 |
| GB | 2171175 | A | 8/1986 |
| GB | 2281872 | A | 3/1995 |
| JP | 02-052061 | | 2/1990 |
| JP | 9-52061 | | 2/1997 |
| JP | 10-230192 | | 9/1998 |
| JP | 11-21956 | A | 1/1999 |
| JP | 2000-027247 | | 1/2000 |
| WO | WO 80/01940 | | 9/1980 |
| WO | WO 86/06654 | | 11/1986 |
| WO | WO 96/25237 | | 8/1996 |
| WO | WO 98/46366 | | 10/1998 |
| WO | 00/32314 | A1 | 6/2000 |
| WO | WO 2004/094990 | | 11/2004 |
| WO | WO 2004/104305 | | 12/2004 |
| WO | WO 2005/018814 | | 3/2005 |
| WO | WO 2005/115554 | | 12/2005 |

OTHER PUBLICATIONS

New Junior size aerators by Marie-Helene Perrin, Apr. 23, 2005, 1 pg.

NEOPERL® Perlator Faucet Aerators, undated, 2 pgs.

* cited by examiner

POWER SPRAYER

CROSS REFERENCE TO RELATED APPLICATIONS

The present application is a continuation of U.S. patent application Ser. No. 12/965,207, filed Dec. 10, 2010, which is a continuation of U.S. patent application Ser. No. 11/383,267, filed May 15, 2006, which claims the benefit of U.S. Provisional Application Ser. No. 60/680,939, filed May 13, 2005 and U.S. Provisional Application Ser. No. 60/771,192, filed Feb. 6, 2006, the disclosures of which are expressly incorporated by reference herein.

BACKGROUND AND SUMMARY OF THE INVENTION

The present invention relates to a water delivery device and, more particularly, to a water delivery device for use with a sink and configured to generate a continuous sheet-like water shield around a stream of water.

According to illustrative embodiment of the present disclosure, a spray head includes a body, and a cartridge assembly received within the body. The cartridge assembly includes an inlet, a first outlet in fluid communication with the inlet and configured to produce a water stream, and a second outlet in fluid communication with the inlet and configured to produce a continuous shield of water extending outwardly in a sheet-like layer around the water stream, the water stream having a substantially laminar flow.

According to a further illustrative embodiment of the present disclosure, a spray head includes a body having a fluid port, and a mount removably received within the body. The spray head further includes a flow straightening member operably coupled to the mount and in fluid communication with the fluid port. The flow straightening member is configured to assist in removing turbulence from the water. A nozzle is operably coupled to the straightening member and includes an outlet orifice configured to produce a center water stream. A whirl member is operably coupled to the mount and is configured to impart rotational movement to the water, thereby producing a continuous shield of water extending around the center water stream.

According to yet another illustrative embodiment of the present disclosure, a method of generating a water pattern includes the steps of producing a center water stream having a substantially laminar flow from a first outlet, and producing an outer continuous shield of water extending outwardly in a sheet-like layer around the center water stream.

According to still a further illustrative embodiment of the present disclosure, a method of generating a water pattern with a water delivery device includes the steps of dividing a supply of water provided to the water delivery device into at least a first portion and a second portion and supplying from the water delivery device a stream of water based on the first portion and a continuous shield of water based on the second portion. The stream of water has a substantially laminar flow and the continuous shield of water surrounds the stream of water.

According to still another illustrative embodiment of the present disclosure, a water deliver system for connection to at least one source of water and for mounting to a sink deck is provided. The water delivery system comprises at least one valve adapted to be in communication with the at least one source of water and an output device coupled to the sink deck. The output device includes an internal waterway and a spray head. The internal waterway is in fluid communication with the valve and with the spray head. The spray head includes a first outlet producing a stream of water and a second outlet producing a continuous shield of water surrounding the stream of water.

Additional features and advantages of the present invention will become apparent to those skilled in the art upon consideration of the following detailed description of the illustrative embodiment exemplifying the best mode of carrying out the invention as presently perceived.

DETAILED DESCRIPTION OF THE DRAWINGS

Figure 1:
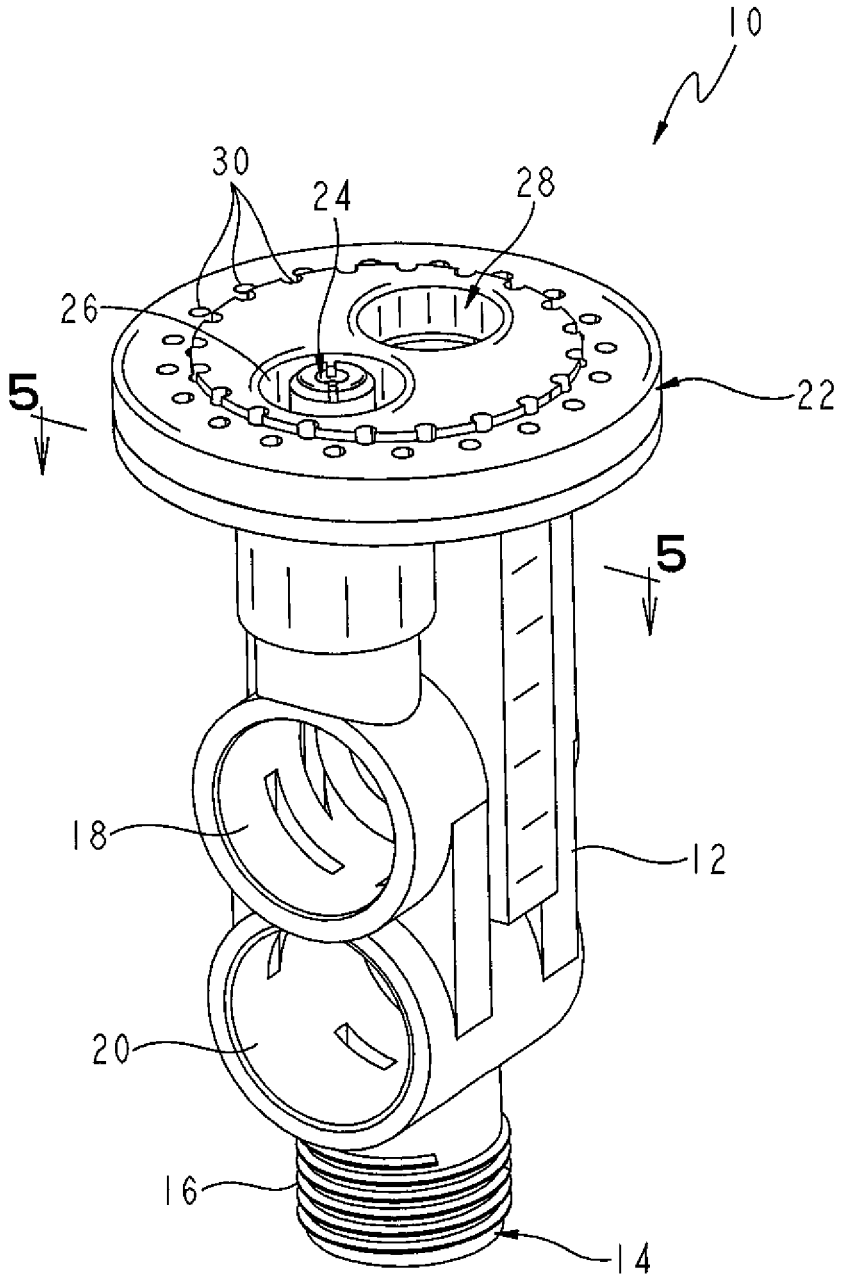
FIG. 1 is a front perspective view of an illustrative embodiment spray head of the present disclosure.
Figure 2:
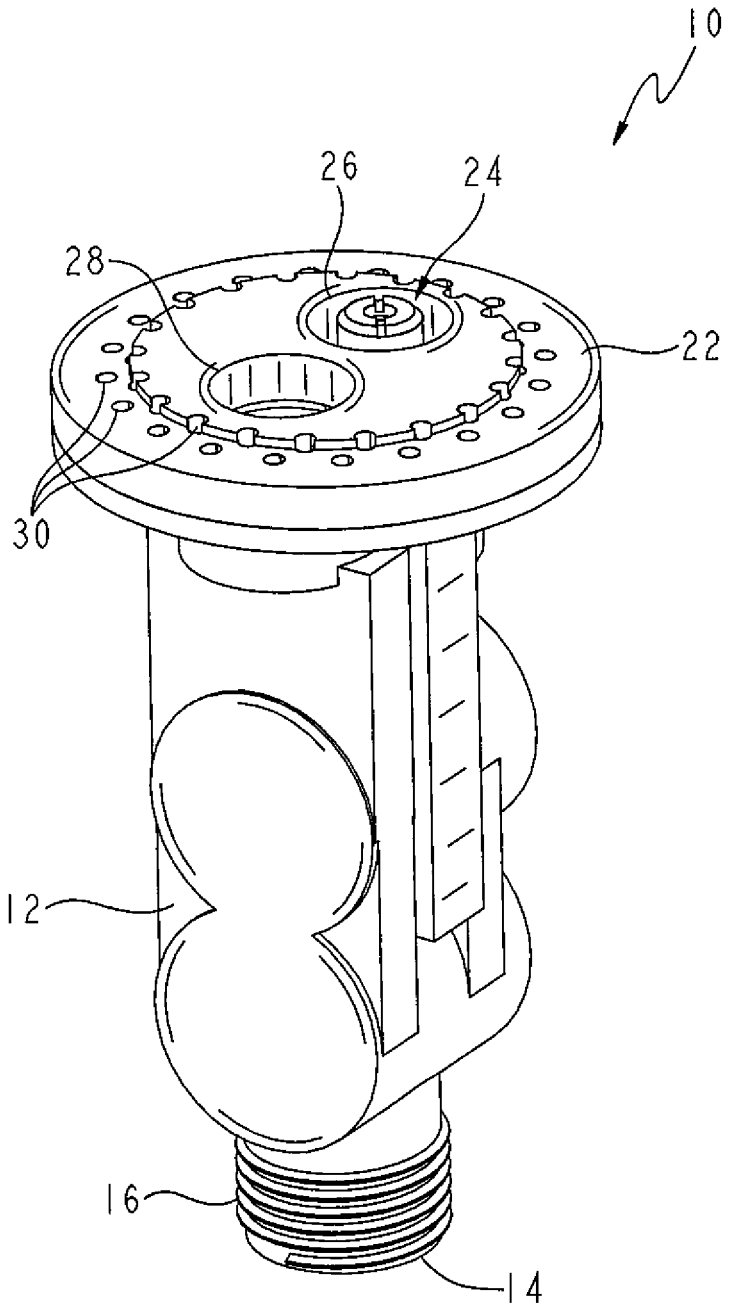
FIG. 2 is a rear perspective view of the spray head of FIG. 1.
Figure 3:
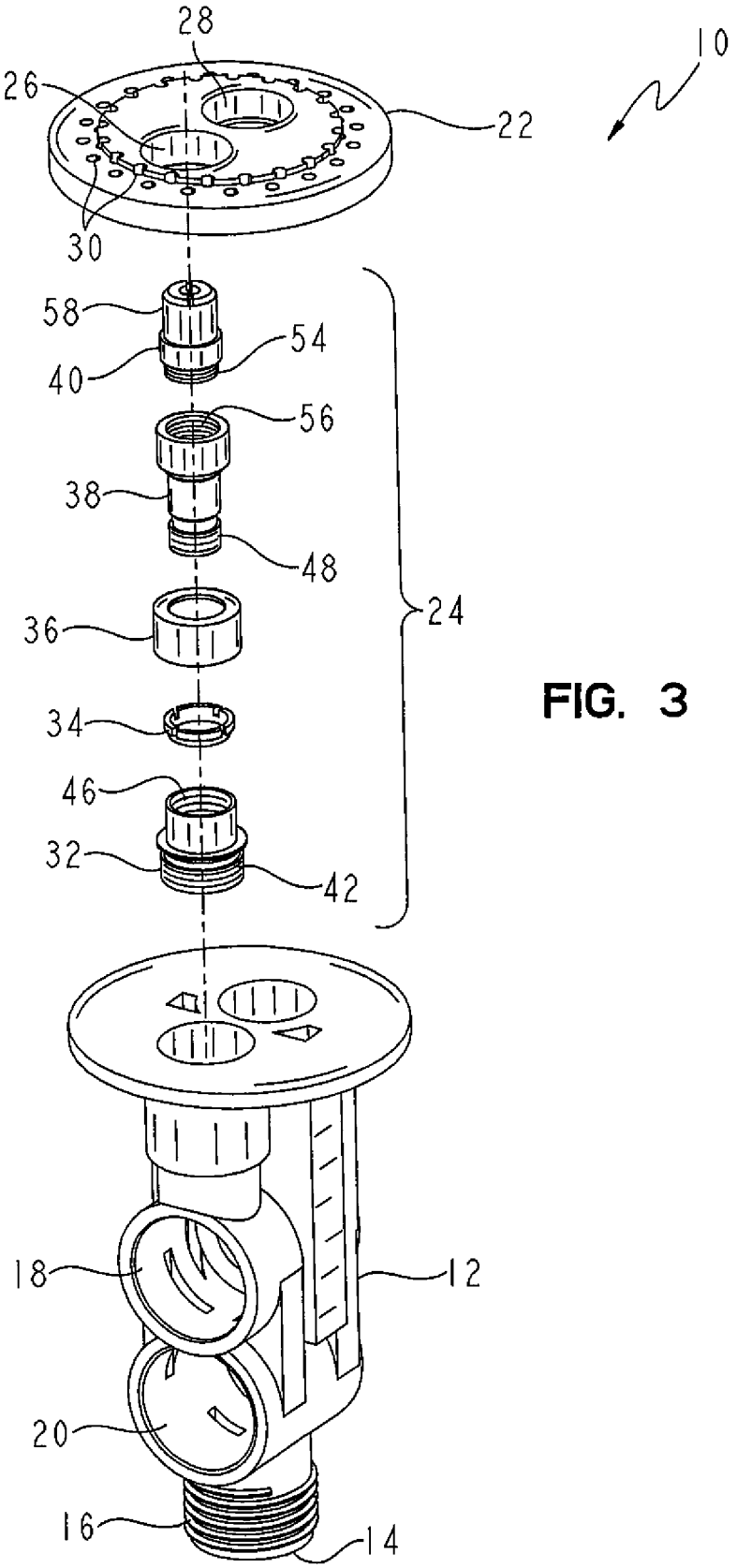
FIG. 3 is an exploded perspective view of the spray head of FIG. 1.

Referring initially to FIGS. 1-3, a spray head 10 according to an illustrative embodiment of the present invention is shown as including a valve body 12 including an inlet fluid port 14 having a plurality of external threads 16 for coupling with a conventional water supply line (not shown). A valve body 12 includes first and second bores 18 and 20 configured to receive conventional valve control members (not shown) for controlling the flow of water from the inlet fluid port 14 to an outlet member 22. More particularly, the valve control members are configured to direct water from the inlet fluid port 14 to different fluid passageways formed within the valve body 12, which are in fluid communication with a cartridge assembly 24 received within a first opening 26 of the outlet member 22, and aerator nozzle (not shown) received within a second opening 28 of the outlet plate 22, and a plurality of circumferentially disposed openings 30 positioned around the first and second openings 26 and 28.

Figure 4:
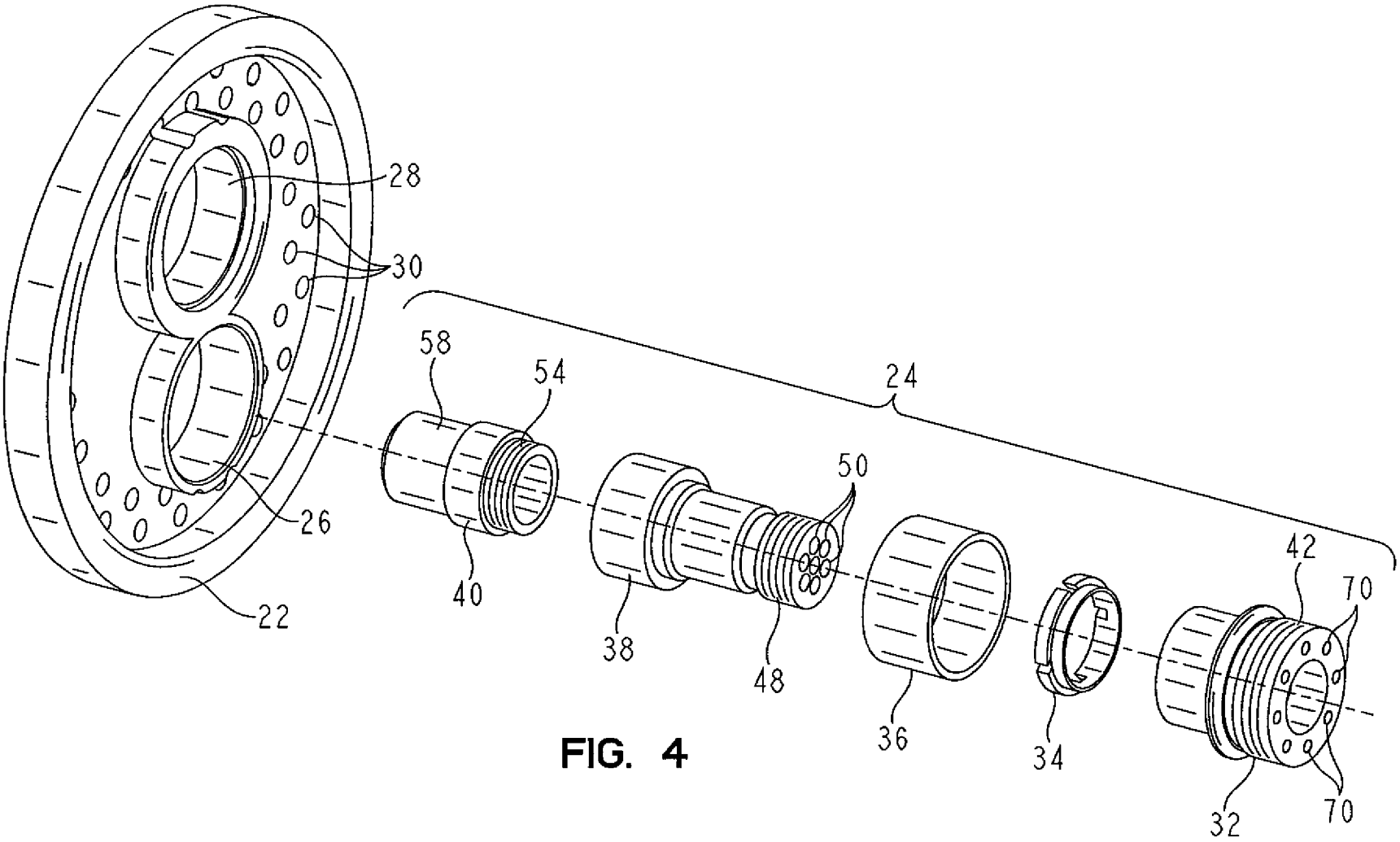
FIG. 4 is an exploded perspective view of the cartridge assembly and outlet member of the spray head of FIG. 1.
Figure 8:
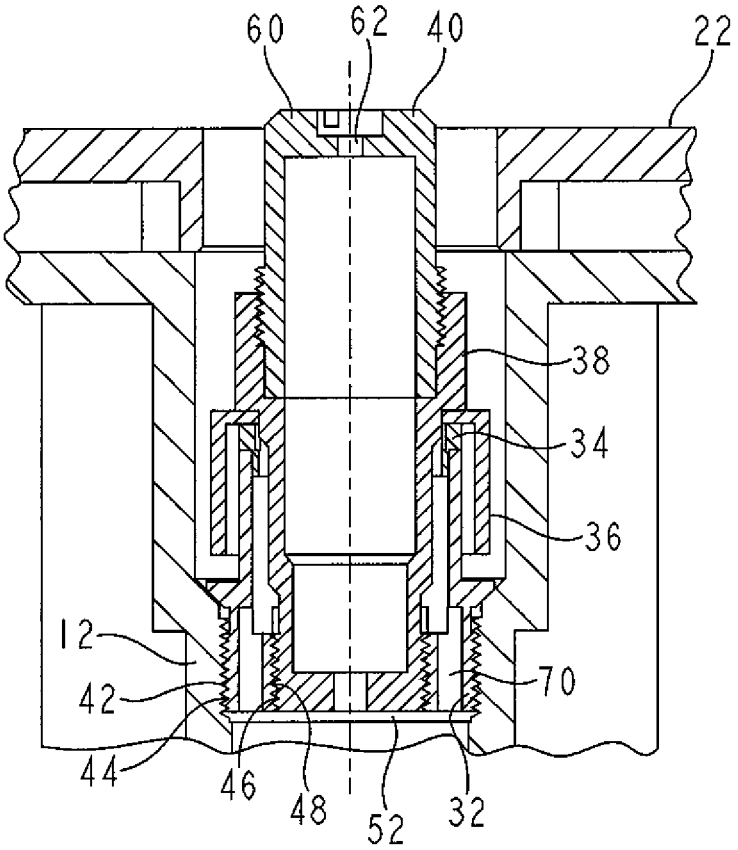
FIG. 8 is a detailed cross-sectional view of the cartridge assembly of FIG. 4.

Referring now to FIGS. 3 and 4, the cartridge assembly 24 includes a holder 32, a whirl member 34, a back reflector 36, a flow straightener 38 and a flow nozzle 40. The holder 32 includes an inner first end having a plurality of external threads 42 to be received within the opening 26 of the valve body 12 and to threadably engage a plurality of internal threads 44 formed therein (FIG. 8). An outer end of the holder 32 includes a plurality of internal threads 46 which threadably engage a plurality of external threads 48 formed on a inner end of the flow straightener 38 (FIG. 8).

Figure 5:
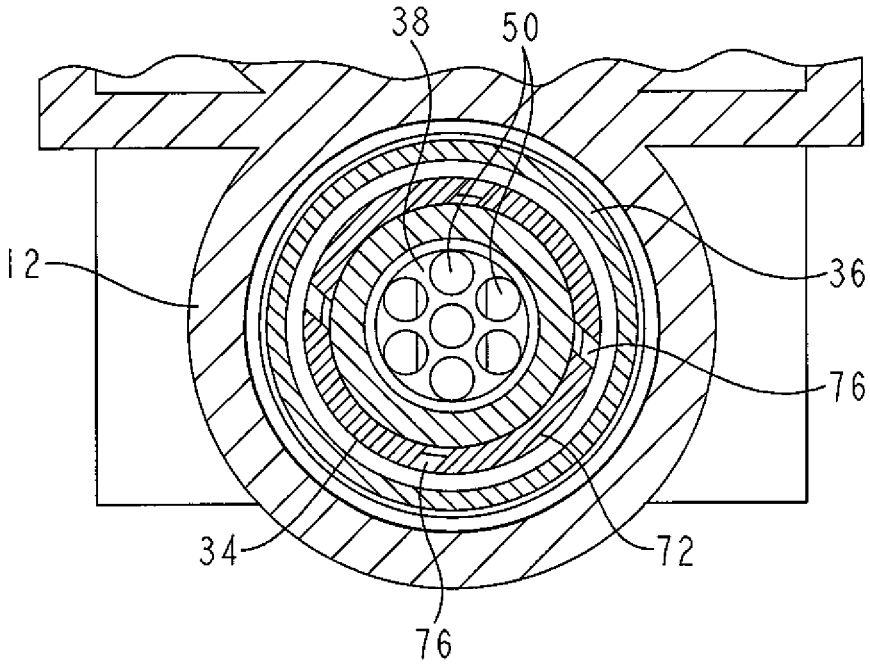
FIG. 5 is a cross-sectional view taken along line 5-5 of FIG. 1.
Figure 7:
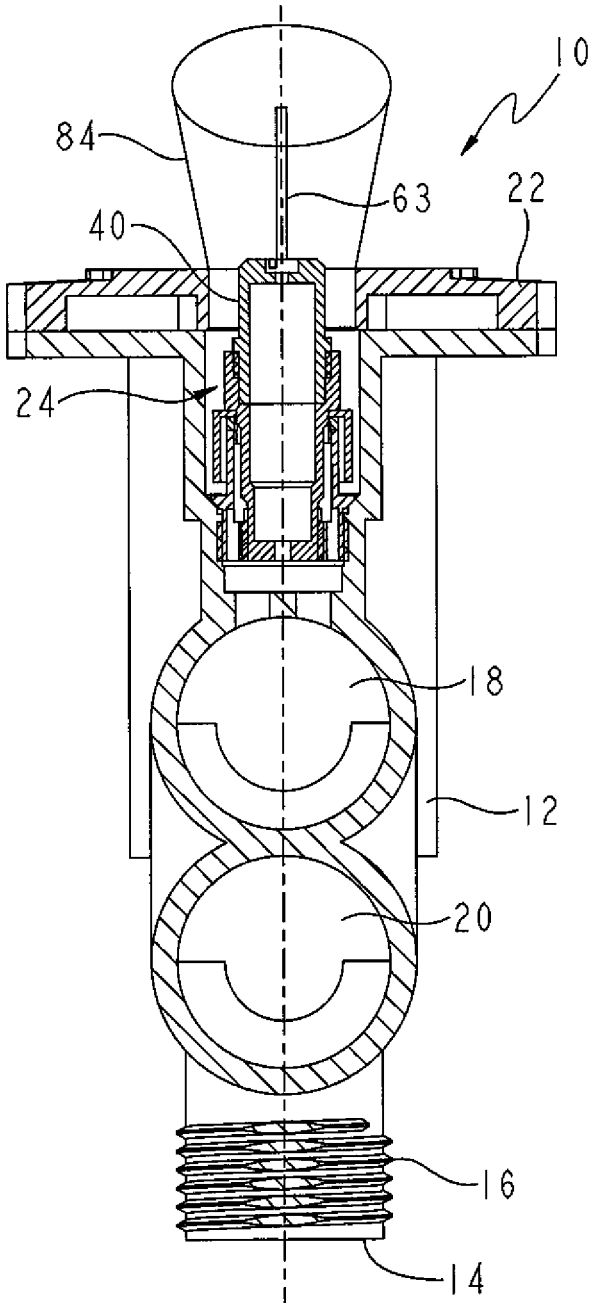
FIG. 7 is a cross-sectional view of the spray head of FIG. 1.
Figure 9:
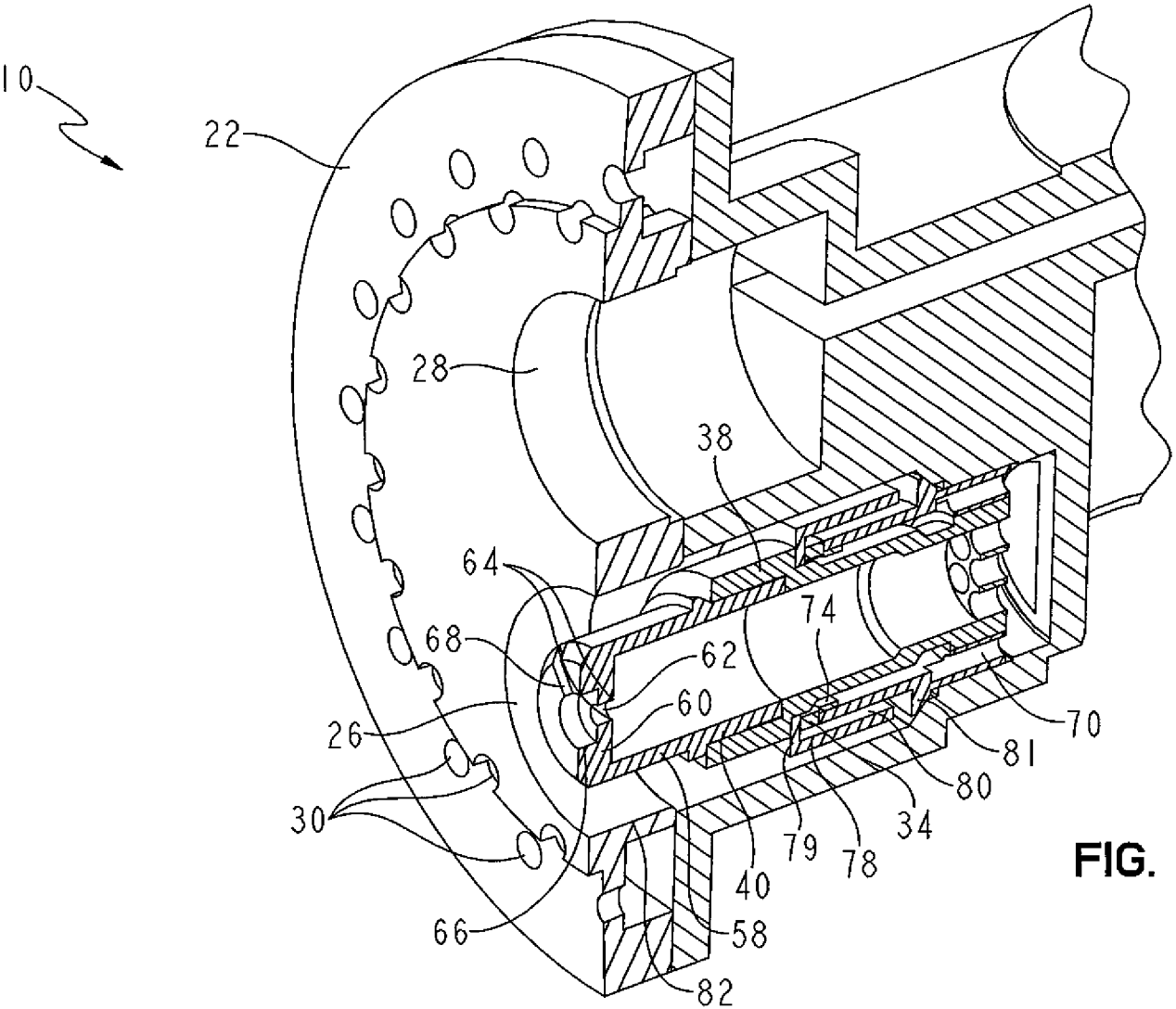
FIG. 9 is an end perspective view of the spray head of FIG. 1, with a partial cut-away thereof.

As shown in FIG. 8, the whirl member 34 and back reflector 36 are captured intermediate the flow straightener 38 and holder 32. Referring to FIG. 5, the flow straightener 38 includes a plurality of parallel, longitudinally aligned bores 50 configured to receive fluid from an inlet 52. The bores 50 are configured to assist in removing turbulence from water flowing therethrough, and provide a more linear flow to the water. Flow nozzle 40 includes an inner end having a plurality of internal threads 54 which threadably engage a plurality of internal threads 56 formed within the outer end of the flow straightener 38. Flow nozzle 40 includes a cylindrical outer wall 58 and a substantially planar end wall 60. An outlet orifice 62 is formed within the end wall 60 such that water passing therethrough forms a center water stream 63 (FIG. 7). The orifice 62 includes sharp entry corners 64 (see FIG. 9) to assist in providing a substantially laminar flow. Additionally, the diameter of the orifice 62 is illustratively at least as great as the thickness of the adjacent planar end wall 60 to further assist in providing a substantially laminar flow to the center water stream. A counter bore 66 is formed in the outer surface of the end wall 60 and a diametrically disposed slot 68 is likewise formed in the outer surface. The slot 68 is configured to receive a tool such as a screw driver to assist in inserting and securing the cartridge assembly 24 within the valve body 12. The counter bore 66 provides a recess to prevent potential damaging contact between the tool and the outlet orifice 62.

Figure 6:
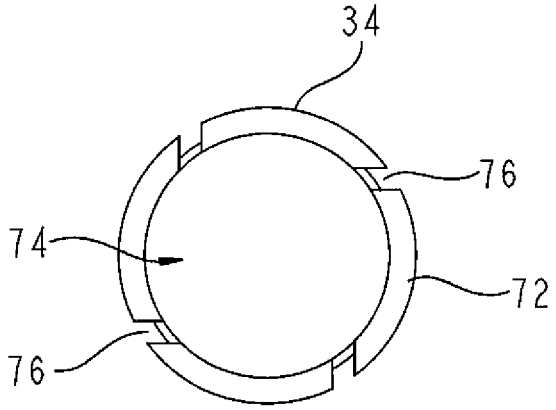
FIG. 6 is a top plan view of the whirl member of the cartridge assembly of FIG. 4.

A plurality of passageways 70 are formed within the holder 32 and are in fluid communication with the whirl member 34. As shown in FIGS. 5 and 6, the whirl member 34 includes an annular body 72 defining a central opening 74 and a plurality of outwardly extending slots 76 which are configured to impart rotational movement to water passing through the annular passageways 70, through the opening 74 intermediate the body 72 and the flow straightener 38, and out through the slot 76. Once the rotational movement is imparted to the water, it passes outwardly due to centrifugal force and contacts an outer cylindrical wall 78 of the back reflector 36. An end wall 79 of the back reflector 36 directs water in a rearward direction through a second annular passageway 80. An end wall 81 formed by the holder and the valve body then redirects the water back in a forward direction and toward a second outlet 82. In other words, the rotating water supplied from the whirl member 34 enters a serpentine passageway that reverses its direction twice as it travels toward the second outlet 82. This redirection of the water in rearward and forward directions assists in making the layer of water substantially uniform. As the water exits the second outlet 82, centrifugal force causes it to define a substantially continuous shield of water 84 having a sheet-like appearance (FIG. 7). In order to reduce turbulence and assist in providing a continuous sheet of water within the shield 84, the surfaces contacted by the rotating water should be substantially smooth. The shield 84 will typically have a conical or bulb-like shape.

Figure 10:
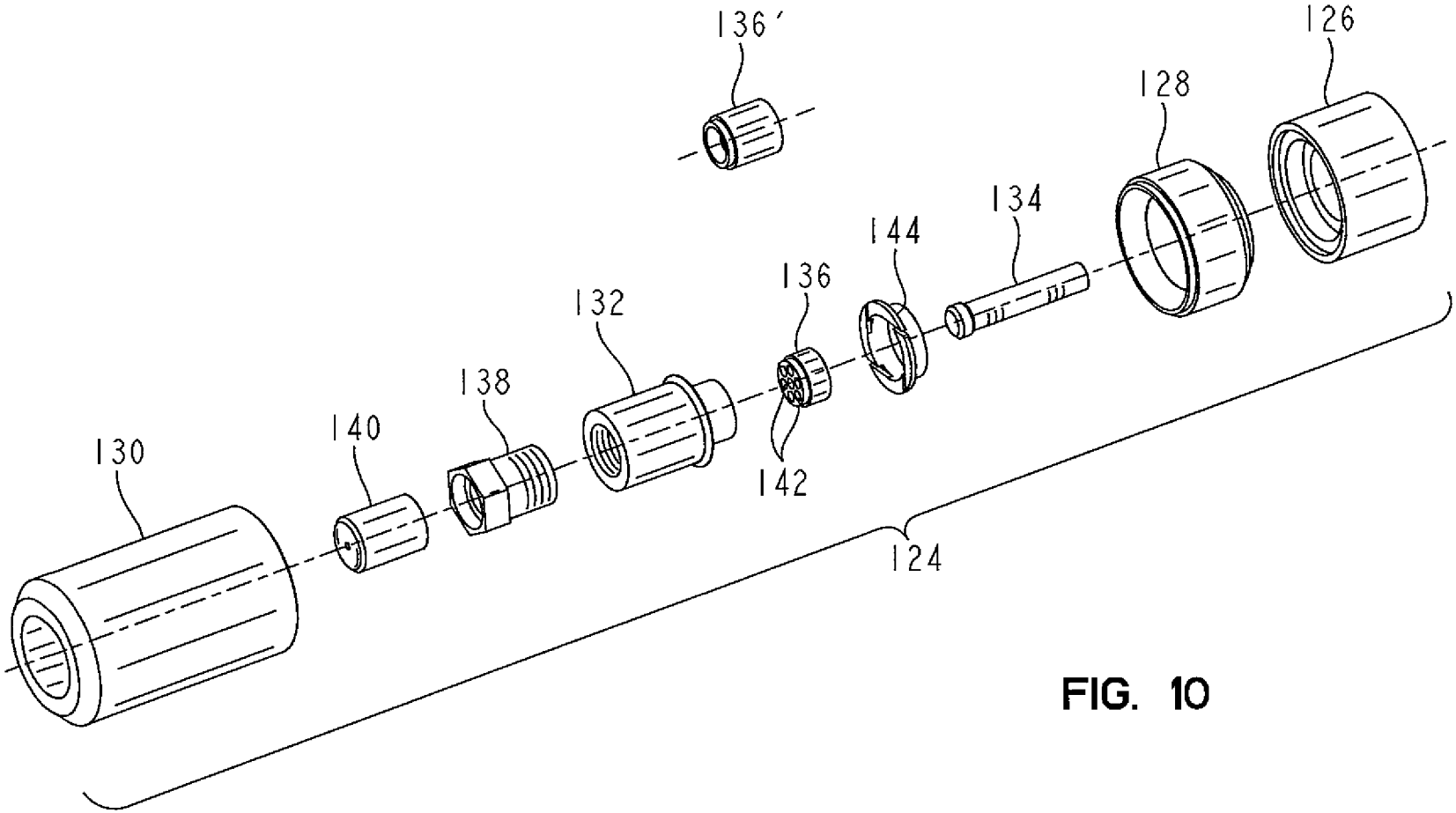
FIG. 10 is an exploded perspective view of a further illustrative embodiment cartridge assembly of the present disclosure.
Figure 11:
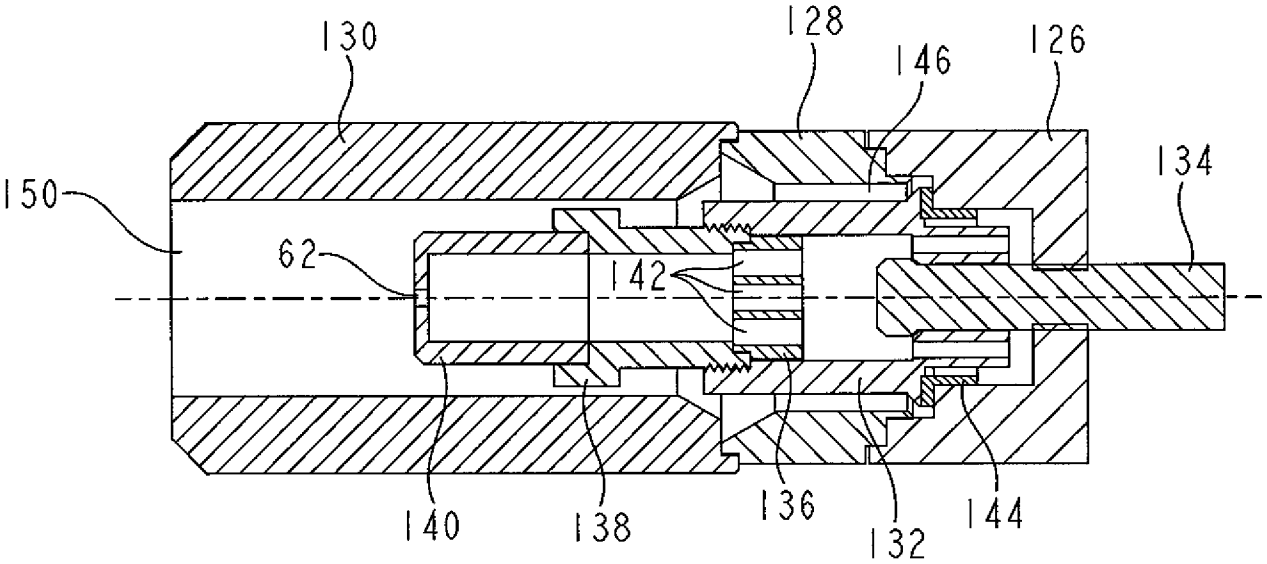
FIG. 11 is a cross-sectional view of the cartridge assembly of FIG. 10.
Figure 12:
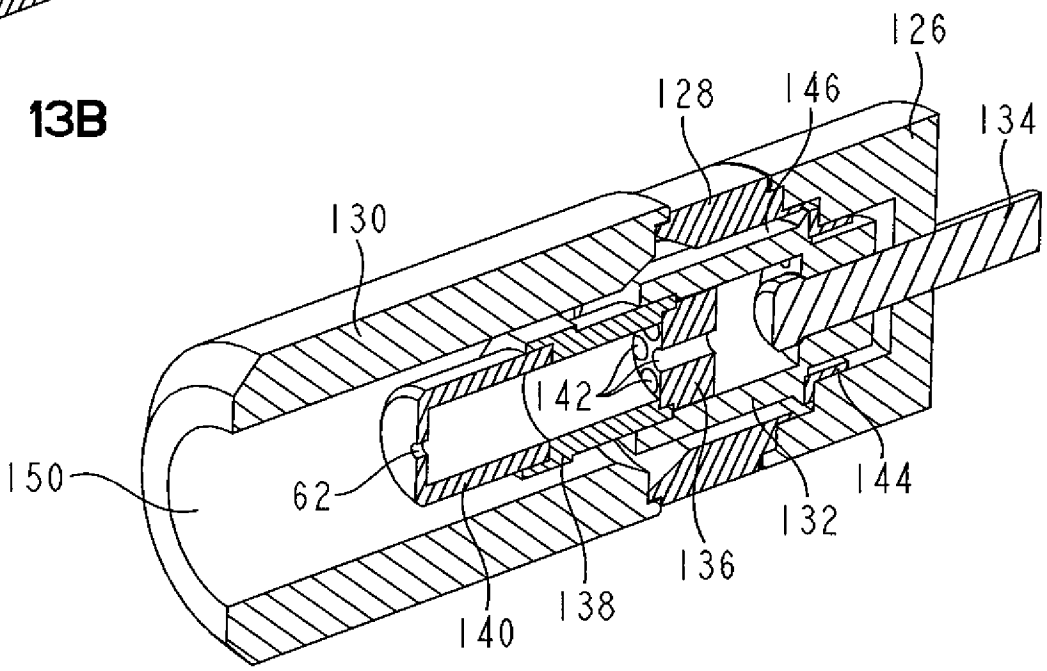
FIG. 12 is a perspective view with a cut-away thereof of the cartridge assembly of FIG. 10.

Turning now to FIGS. 10-12, a further illustrative embodiment of the valve cartridge assembly 124 of the present invention is illustrated. The valve cartridge assembly 124 includes a base 126 which threadably receives a shroud 128. Similarly, a shroud shaper 130 threadably receives the shroud 128. A nozzle mount 132 is operably coupled to the base 126 through a conventional fastener, such as a screw 134. A flow straightener 136 is concentrically received within the nozzle mount 132. The flow straightener 136 is secured in position by means of a nozzle body 138 which is threadably received within an outer end of the nozzle mount 132. A nozzle 140 is threadably received within an outer end of the nozzle body 138.

The nozzle mount 132 and the flow straightener 136 cooperate to assist in removing turbulence from water flowing therethrough. More particularly, the flow straightener 136 includes a plurality of parallel bores 142 (see FIG. 11) configured to cause a substantially linear flow of water therethrough. The nozzle 140 is of a design similar to nozzle 40 detailed herein.

Figure 13A:
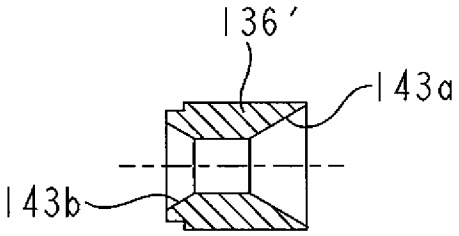
FIG. 13A is a cross-sectional view of an illustrative flow straightener.
Figure 13B:
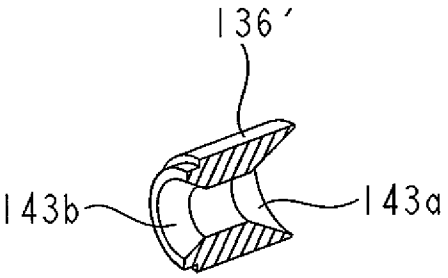
FIG. 13B is a perspective view with a cutaway thereof of the flow straightener of FIG. 13A.

Referring to FIGS. 13A and 13B, an alternative embodiment flow straightener 136' includes an inwardly facing conical surface 143*a* and an outwardly facing conical surface 143*b*. The flow straightener 136' may be substituted for flow straightener 136 to facilitate the removal of turbulence from water passing therethrough.

A whirl member 144 is retained within the base 126 by the nozzle mount 132. The whirl member 144 may be of a design similar to whirl member 34 as detailed herein. As note above, the whirl member 144 is configured to impart rotational movement to water passing therethrough, wherein the water then extends into an annular passageway 146 and into the shroud shaper 130. Because the water adheres to the inner surface of the outer wall of the shroud shaper 130 it generates a conical or bulb-like continuous shield of water as it exits through outlet 150. As detailed above, the outlet orifice 62 of the nozzle 140 generates a center stream of water disposed within the shield of water.

Figure 14:
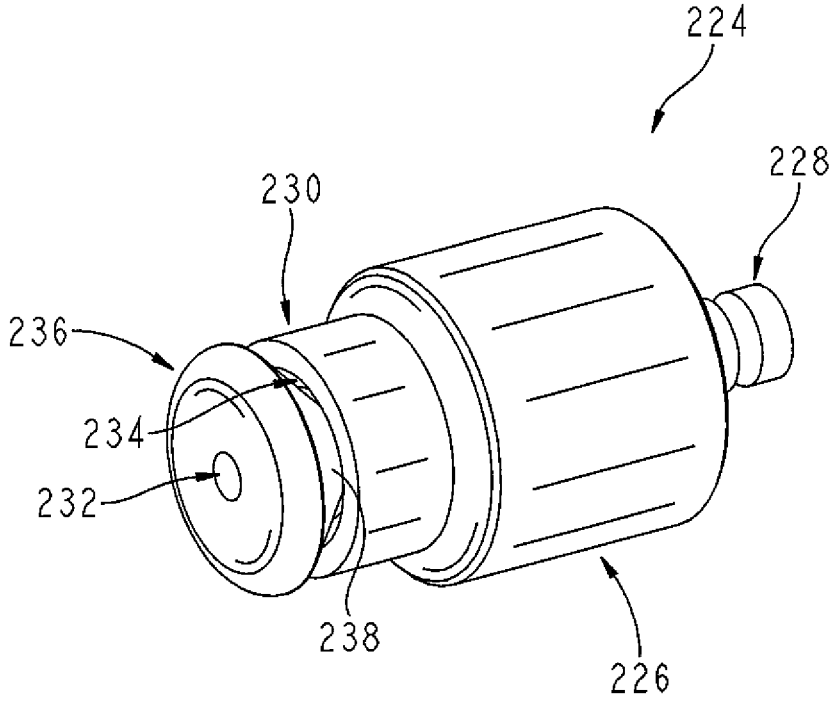
FIG. 14 is a perspective view of a further illustrative embodiment cartridge assembly.
Figure 15:
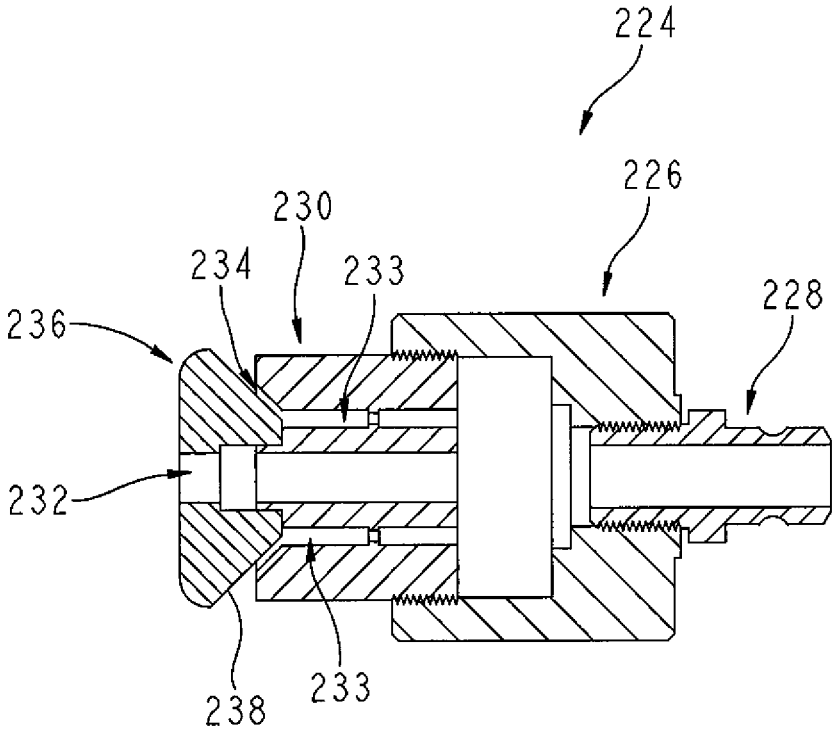
FIG. 15 is a cross-sectional view of the cartridge assembly of FIG. 14.
Figure 16:
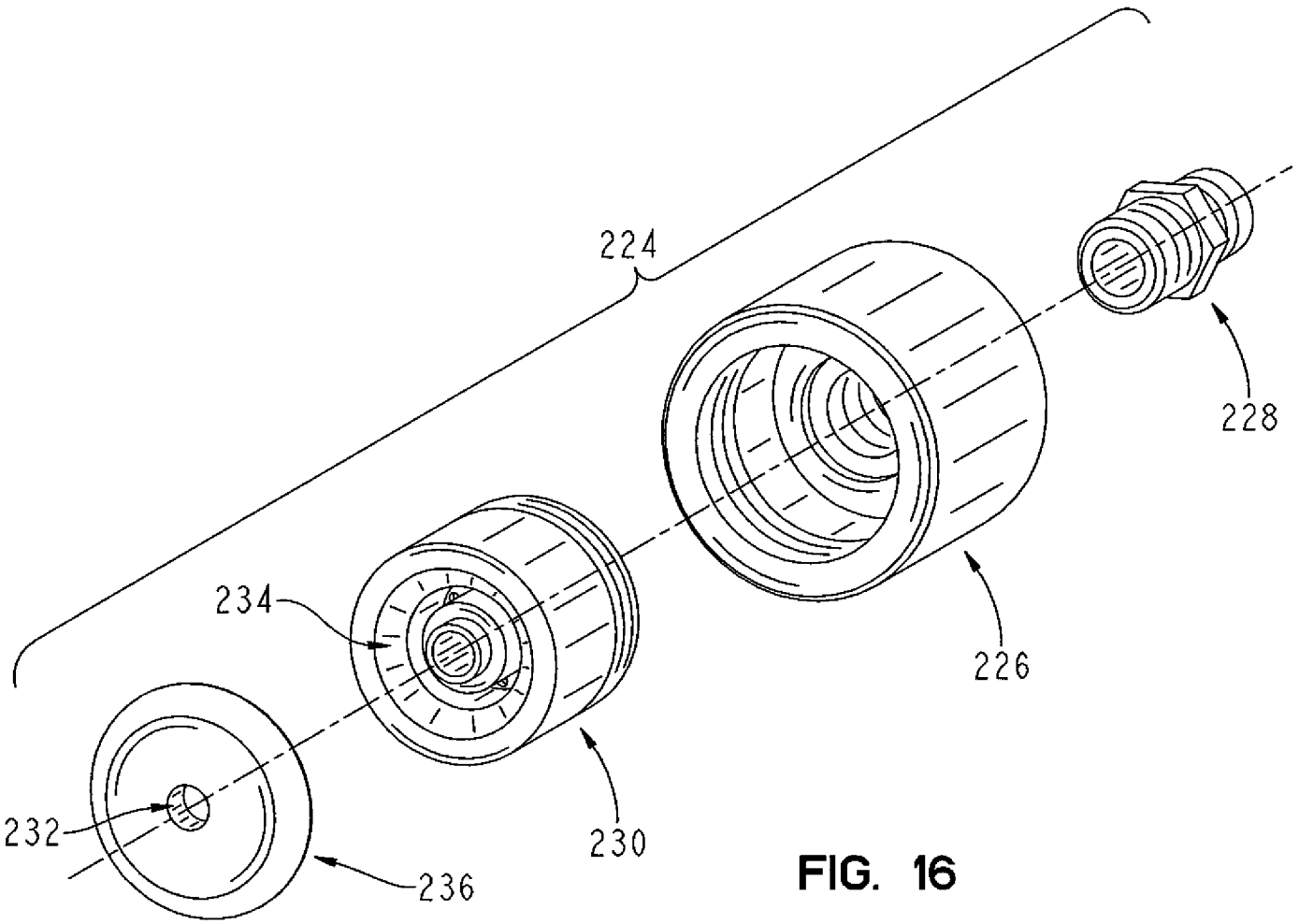
FIG. 16 is an exploded perspective view of the cartridge assembly of FIG. 14.

FIGS. 14-16 show another illustrative embodiment cartridge assembly 224 of the present invention. Cartridge assembly 224 includes a base 226 having an inlet 228. Inlet 228 is illustrated as a separate component coupled to base 226. However, inlet 228 may be integrally formed as apart of base 226. A nozzle 230 is threadably received within the base 226 and includes a center first outlet 232 and an annular second outlet 234 disposed concentrically around the first outlet 232. A conical member 236 is supported concentrically around the center first outlet and provides a Coanda effect surface 238. More particularly, water passing through the inlet 228 to the center first outlet 232 generates a water stream which is illustrated as centrally located. Water passing through passageways 233 in nozzle 230 and onto the annular second outlet 234 contacts the Coanda effect surface 238 of the conical member 236. A Coanda effect results in adhesion of the water to the surface 238 by surface tension, such that the water passing beyond the conical member 236 produces a substantially continuous shield of water in a sheet-like manner around the center water stream.

Figure 17:
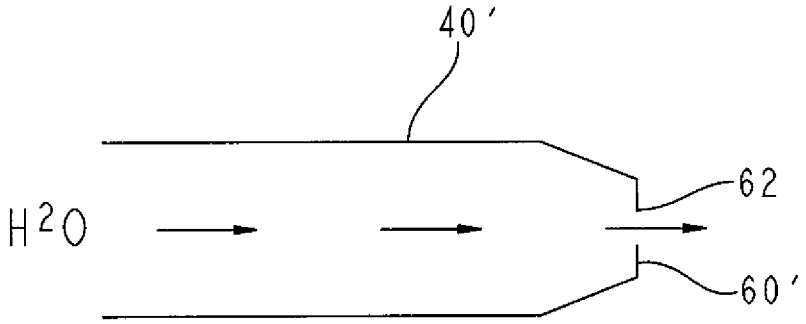
FIG. 17 is a representative view of a further embodiment nozzle.

FIG. 17 illustrates an alternative embodiment for producing a substantially laminar flow through the outlet orifice 62 of a nozzle 40'. In this embodiment, instead of a substantially planar end wall 60, the end wall 60' includes a conical surface directing water to the outlet orifice 62.

It should be appreciated that the substantially laminar flow of the center stream 63 reduces splashing or misting in response to water contacting a surface 280. Additionally, the water shield 84 protects against splash, mist and dislodged debris when using a power spray to clean surfaces, such as dishes, sink, etc. It is also possible to replace the continuous water shield with an aerated shield.

As discussed herein, the various illustrated embodiments provide a central flow of water having a generally laminar stream, such as stream 63 in FIG. 7, and a continuous shield of water, such as shield 83 in FIG. 7, surrounding the central flow of water. The continuous shield of water may also surround a flow of water, central or offset, having a substantially non-laminar stream.

Figure 18:
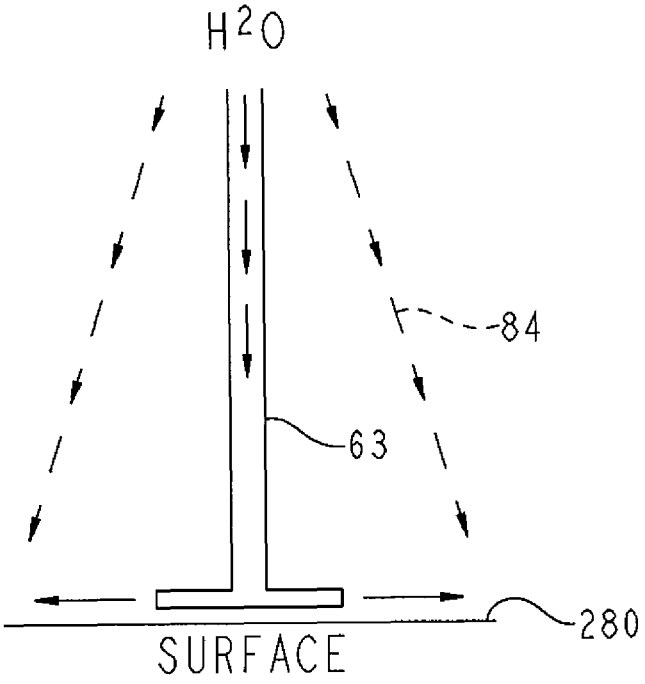
FIG. 18 is a side, schematic view showing an illustrative velocity circle formed by a substantially laminar stream.
Figure 19:
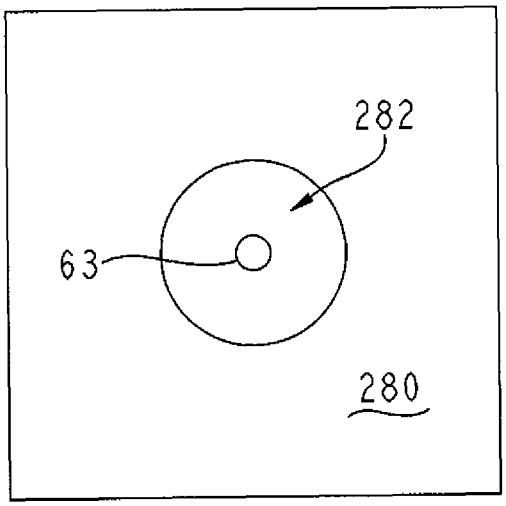
FIG. 19 is a top, schematic view showing an illustrative velocity circle formed by a substantially laminar stream.

Referring to FIGS. 18 and 19, substantially laminar stream 63 is surrounded by shield 84, which essentially acts as a splash barrier. As substantially laminar stream 63 impacts surface 280 (such as a surface of a dish), fluid follows surface 280 in a direction radially outwardly from the center axis of stream 63. More particularly, the substantially laminar characteristics of stream 63 and the Coanda effect causes the fluid to generate a velocity zone 282, substantially circular, which extends outwardly to mix with fluid from shield 84 impacting surface 280. When substantially laminar stream 63 contacts surface 280, it creates a substantially circular zone 282 (illustratively about 1 inch in diameter) that is of a high pressure and flows parallel to surface 280. Water flow within zone 282 thus tends to strip particles from surface 280 to facilitate cleaning, similar to a mechanical scraping. Further, fluid from stream 63 and from shield 84 combine to form a turbulent flow which also facilitates cleaning of surface 280.

Figure 20:
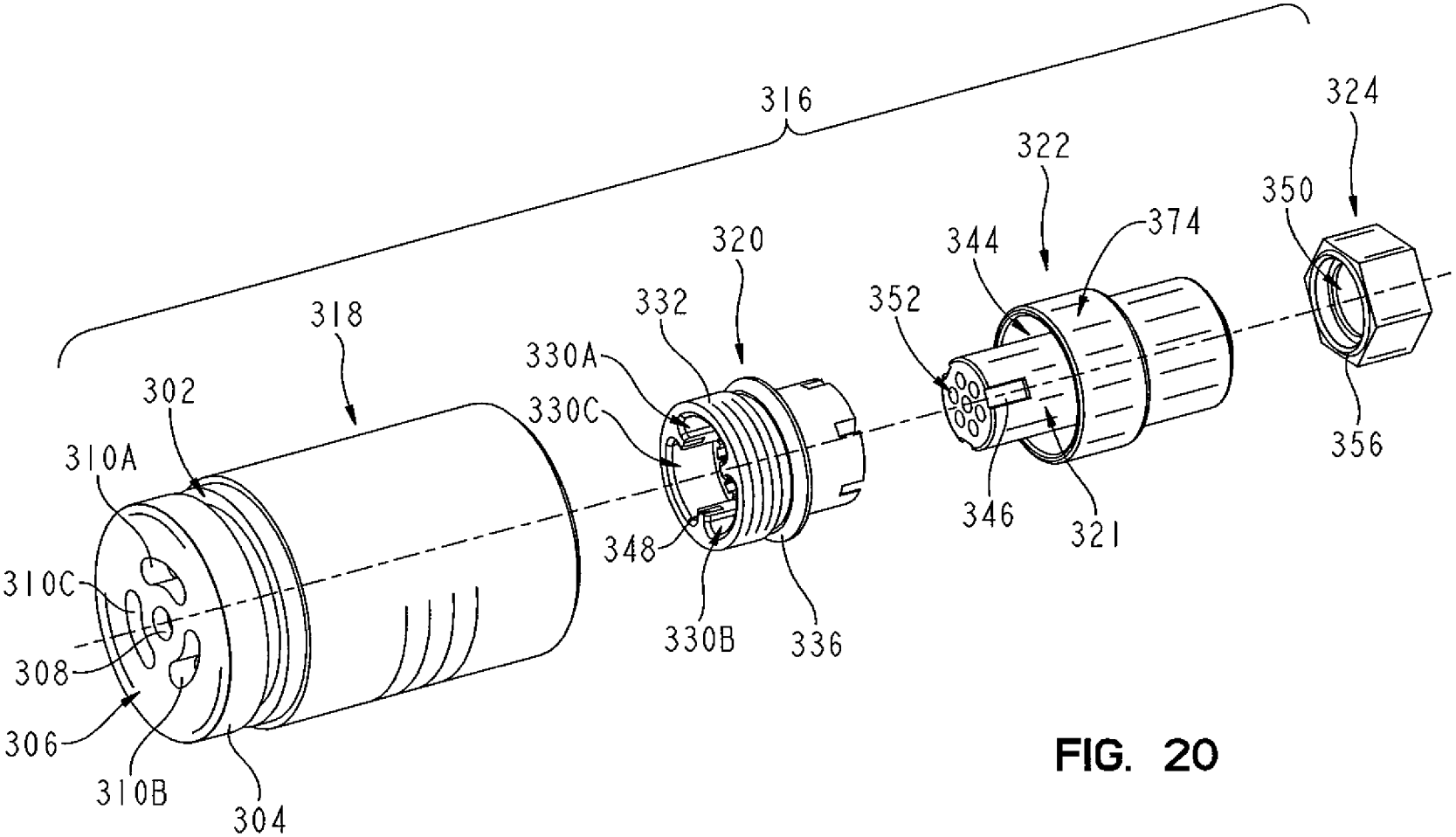
FIG. 20 is an exploded perspective view of a further embodiment cartridge assembly.
Figure 21:
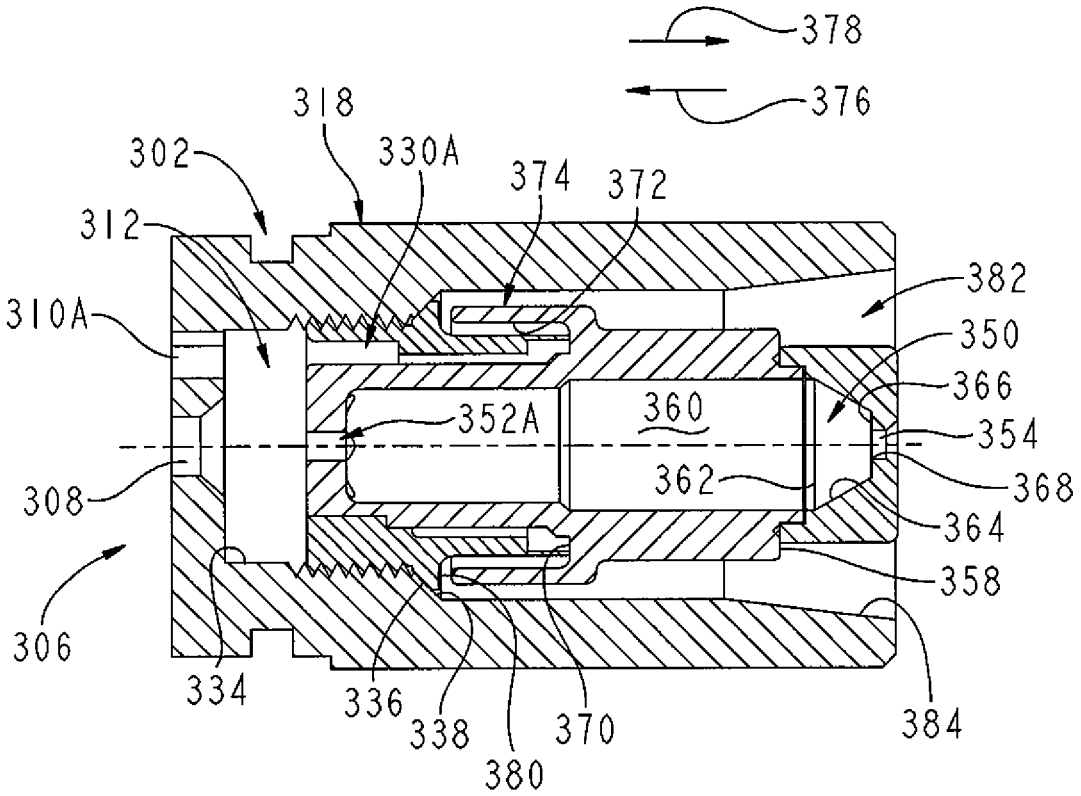
FIG. 21 is a cross-sectional view of the cartridge assembly of FIG. 20.
Figure 22:
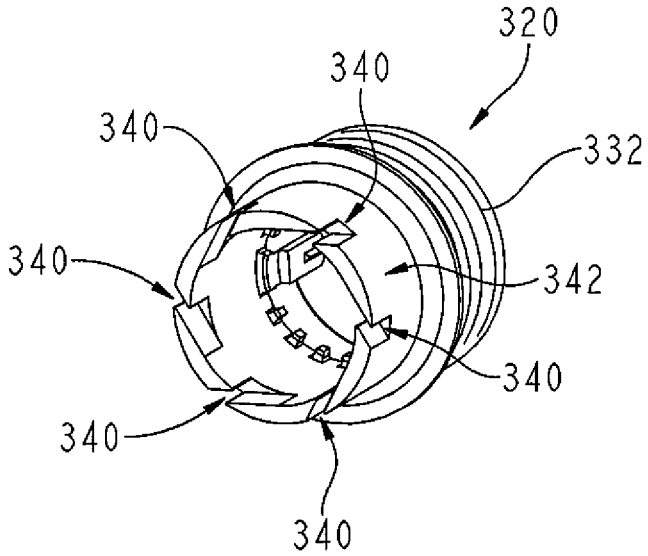
FIG. 22 is a perspective view of an inlet member of the cartridge assembly of FIG. 20.

Referring to FIGS. 20-22 a further embodiment cartridge assembly 316 is shown. Cartridge assembly 316 may be received in valve body 12 and includes a holder 318, an inlet member 320, a flow straightener 322, and an outlet member 324. As explained herein outlet member 324 provides a substantially laminar flow of water. Surface 304 of holder 318 cooperate with valve body 12 to couple cartridge assembly 316 to valve body 12. In one embodiment, a coupler, such as a fastener, is received in opening 308 to couple holder 318 to valve body 12. In one embodiment, surface 304 is threaded and is threadably engaged with valve body 12 to permit removal of valve cartridge 316 from valve body 12. A seal (not shown) is carried in a recess 302 of holder to provide a fluid tight seal between valve body 12 and a periphery of holder 318.

Holder 318 includes an inlet 306 which is in fluid communication with the internal fluid passageways of valve body 12. Illustratively inlet 306 includes three elongated orifices 310A-C. Inlet 306 may have fewer or more orifices. Referring to FIG. 21, orifices 310A-C (310A illustrated) are generally aligned with passageways 330A-C formed by the cooperation of inlet member 320 and flow straightener 322. Orifices 310A-C are in fluid communication with a region 312 in holder 318 between holder 318 and inlet member 320.

Inlet member 320 is coupled to holder 318. In one embodiment surface 332 of inlet member 320 and surface 334 of holder 318 are each threaded. In one embodiment, surfaces 332 and 334 are sized such that holder 318 and inlet member 320 may be sonically welded together. An angled surface 336 of inlet member 320 and an angled surface 338 of holder 318 cooperate to assist in sealing the periphery of inlet member 320 relative to holder 318.

Surfaces 348 (illustratively three surfaces) of flow straightener 322 and surfaces 348 (illustratively three surfaces) of inlet member 320 are sized such that flow straightener 322 may be sonically welded to inlet member 320. In one embodiment, flow straightener 322 is coupled to inlet member 320 by other suitable means, such as threads.

Referring to FIG. 22, inlet member 320 includes a plurality of slot 340 are in fluid communication with passageways 330 and which impart a rotational movement to the water to assist in the formation of the continuous shield of water, as explained below. The central portion of inlet member 320 receives a body portion 321 of flow straightener 322. A lower portion 342 of inlet member 320 which contains slots 340 is received within an opening 344 of flow straightener 322 between body portion 321 and a deflector portion 374 of flow straightener 322.

Outlet member 324 includes a recess 350 which is in fluid communication with fluid passages 352 in flow straightener 322. Recess 350 terminates in an outlet orifice 354. Outlet member 324 includes a raised portion 356 which cooperates with a surface 358 of flow straightener 322 to permit outlet member 324 to be sonically welded to flow straightener 322. In one embodiment, flow straightener 322 is coupled to outlet member 324 by other suitable means, such as threads.

In operation, water enters valve cartridge 316 through orifices 310A-C. As explained herein, a first portion of the water entering valve cartridge 316 exits as a stream of water, similar to stream 63, and a second portion of the water entering valve cartridge 316 exits as a continuous shield of water, similar to shield 84.

Body portion 321 of flow straightener 322 includes a plurality of passageways 352. Illustratively passageways 352 are a plurality of parallel, longitudinally aligned bores (see 352A in FIG. 21) which are configured to assist in removing turbulence from fluid flowing there through, and provide a more linear flow to the fluid. Water passing through passageways 352 is communicated to an internal waterway 360 in flow straightener 322 and onto recess 350 in outlet member 324. Recess 350 includes a cylindrical outer wall 362 and a tapered or conical inner wall 364. Conical inner wall 364 abuts a substantially planar end wall 366 defining outlet orifice 354, such that water passing there through forms a center water stream similar to stream 63. Orifice 354 includes sharp entry corners 368 to assist in providing a substantially laminar flow to the outlet stream. In one embodiment, the outlet stream has a substantially laminar flow.

A continuous shield of water is formed by water that enters passageways 330A-C formed by inlet member 320 and flow straightener 322. Passageways 330A-C are in fluid communication with slots 340 positioned at a lower end of inlet member 320. Slots 340 and a lower surface 370 of flow straightener 322 change the direction of flow of the water and impart rotational movement to the water passing there through. Once the rotational movement is imparted to the water, it moves outwardly to a side wall 372 of deflector member 374 of flow straightener 322 and is directed backwards in direction 376. The water continues generally in direction 376 until it is redirected forward again in direction 378 by surface 380 of inlet member 320. The water travels generally in direction 378 toward a shield outlet 382.

As the fluid moves toward shield outlet 382, centrifugal force causes it to follow an inner surface 384 of holder 318. Due to the well-known Coanda effect, where fluid flowing along a solid surface which is curved slightly from the stream tends to follow the surface, the fluid defines a substantially continuous shield of fluid, generally similar to shield 84 having a sheet-like appearance. As shown in FIG. 21, inner surface 384 illustratively includes a flared or angled portion extending toward shield outlet 382. In order to reduce turbulence and to assist in providing a continuous sheet of water within the shield, inner surface 384 contacted by the rotating fluid should be substantially smooth.

The flared portion of surface 384 assists in shaping the appearance of the continuous sheet of water. The flared portion causes the appearance of the continuous sheet of water to be more conical and less spherical.

Additional details regarding cartridge assembly 316 are provided in U.S. Provisional Patent Application Ser. No. 60/771,192, filed Feb. 6, 2006, the disclosure of which has been expressly incorporated by reference herein.

Figure 23:
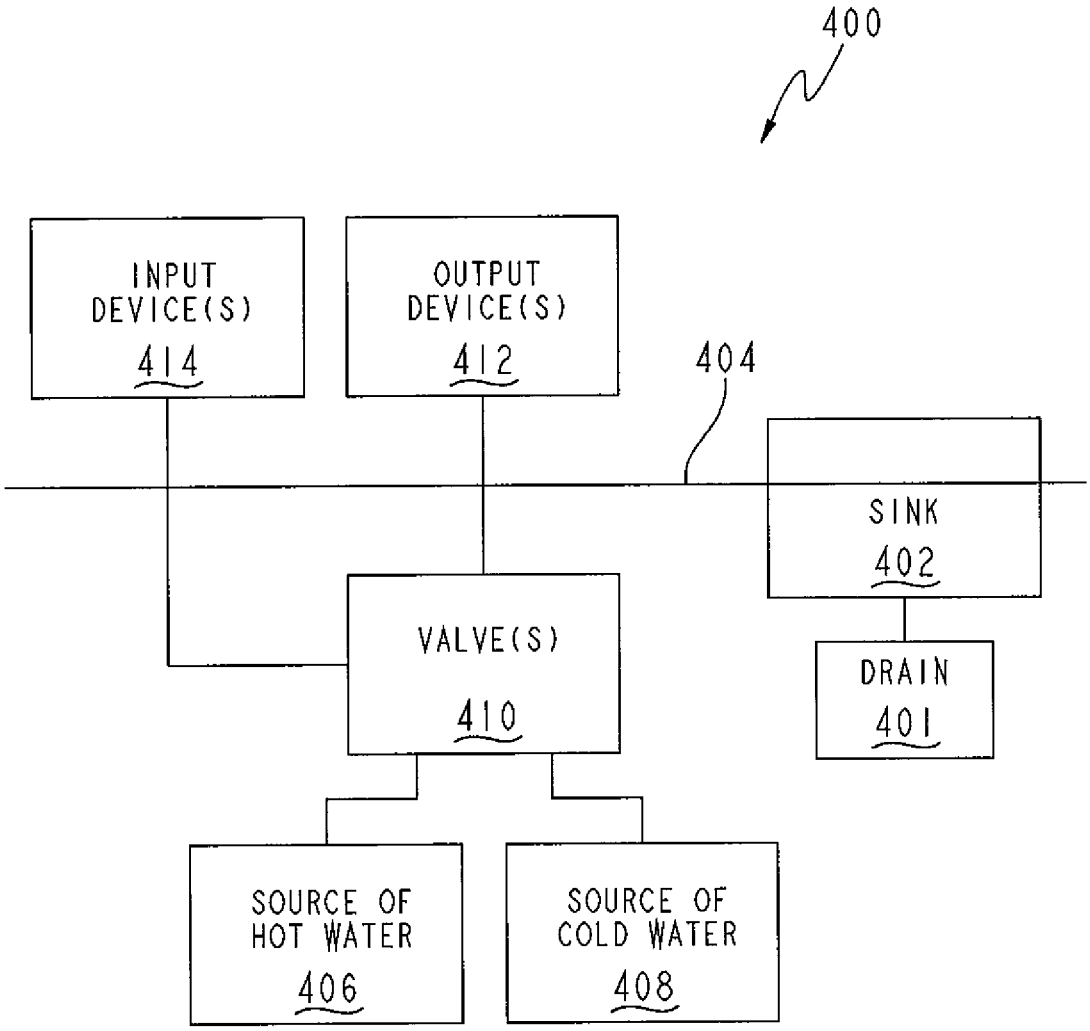
FIG. 23 is a diagrammatic view of an exemplary water delivery system.

As illustrated in FIG. 23, the spray heads and valve cartridges discussed herein may be used as apart of a water delivery system 400 for use with a sink 402 having a drain 401 or other device, residential or commercial, associated with a drain. Sink 402 is shown being coupled to a countertop 404. The countertop 404 and a top portion of the sink 402 are collectively referred to as the sink deck. Water delivery system 400 is coupled to a source of hot water 406 and a source of cold water 408. Water from the source of hot water 406 and source of cold water 408 are provided to one or more valves 410 which may be adjusted to regulate the flow of water there through.

In one embodiment, the source of hot water 406 and the source of cold water 408 are both in fluid communication with a single mixing valve which regulates the flow rate of water from each source 406, 408 which is to be provided to an output device 412, if any depending on the water characteristics desired. For instance, only hot water may be desired so the valve would only pass water from the source of hot water 406. In another embodiment, the source of hot water 406 and the source of cold water 408 are each in fluid communication with a respective valve; each valve regulating the flow of water to be provided to the output device 412 from the respective source of water in fluid communication with the valve. Valve 410 may be positioned above the sink deck or below the sink deck.

The control of valve 410 is through one or more input devices 414. Exemplary input devices 414 include both mechanical input devices, such as handles, and electronic input devices, such as a touch sensor or an infrared sensor, which provide an indication to a controller of the water characteristics desired. In one example, the controller adjusts valve 410 through a motor coupled to valve.

Exemplary output devices 412 include a spout having a spray head coupled thereto. The spout may be rigid or may have a flexible portion. In one embodiment, spray head is a swivel head attached to the end of a spout base member. In one embodiment, spray head is a pull out wand which is attached to a spout base member. The pull out wand having a first position generally coupled to spout base member and a second position wherein the wand is spaced apart from the spout base member and connected thereto through a waterway connecting the two. Another exemplary output device is a side spray. Exemplary side sprays are disclosed in U.S. Provisional Application Ser. No. 60/771,192, filed Feb. 6, 2006, the disclosure of which is expressly incorporated by reference herein. In one embodiment, spray head is incorporated into a side spray which may be coupled to the sink deck and is in fluid communication with valve 410. In one example side spray is in fluid communication with valve 410 independent of a spout. In one embodiment, spray head may be used with any type of water delivery device which is coupled to a sink deck and used in combination with a sink 402.

In one embodiment, water delivery system 400 is associated with a bathtub, a shower, or other receptacle having an associated drain, such as drain 401 associated with sink 402 in FIG. 23. As such, the spray heads and/or valve cartridges disclosed herein may be used to provide a continuous shield surrounding a stream of water as part of a tub filler, a showerhead, and/or a body spray.

In one example, using the continuous shield and stream combination may reduce the amount of steam produced in a shower setting. In effect, a portion of air may be trapped between the stream and the continuous shield. As such, steam generated from the stream is generally trapped inside the shield thereby limiting the humidity in the bathroom.

In one embodiment, the spray heads and/or valve cartridges disclosed herein may be configured to include multiple streams of water surrounded by the continuous stream. Each stream may have a substantially laminar flow or a non-laminar flow. In one embodiment, the spray heads and/or valve cartridges disclosed herein may be configured to include multiple continuous shields of water. In one embodiment, the spray heads and/or valve cartridges disclosed herein may be configured to include one or more streams of the water, each stream having one of a substantially laminar flow or a non-laminar flow, and one or more continuous shields of water surrounding the one or more streams of water.

In one embodiment, the inlet to the water passage to generate the stream of water and the inlet to the water passage to generate the shield of water are independent of each other, such that water may be presented to only the water passage to generate the stream of water, to only the water passage to generate the shield of water, or to both the water passage to generate the shield of water and the water passage to generate the stream of water. The water delivery system 400 may include separate water conduits from valve 410 connecting to the water passage to generate the stream of water and the water passage to generate the shield of water. As such, a user may select with input device 414 to generate a stream of water only, to generate a shield of water only, or to generate a combination of a stream of water and a continuous shield of water. In one example, the water shield only mode may be used for a rinsing application.

In one embodiment, the continuous shield of water has a generally football shaped appearance. In one embodiment, the shape of the continuous shield of water is influenced by the pressure of the water. At standard pressures for residential applications, the shape of the continuous shield is generally a half of a football or generally conical. At lower pressures the shape of the continuous shield is generally football shaped. As such, the pressure related to the water in the continuous shield may be chosen to select an aesthetically pleasing appearance. In one example, the pressure is chosen such that the appearance of the water shield provides a bubble around a stream of water. The shape of the continuous shield may also be influenced by the temperature of the water.

Although the invention has been described in detail with reference to certain preferred embodiments, variations and modifications exist within the spirit and scope of the invention as described and defined in the following claims.

The invention claimed is:

1. A spray head for use with a water delivery system comprising:

a body including a fluid port configured to be coupled to a water supply;

a cartridge received within the body, the cartridge including an inlet in fluid communication with the fluid port, a first outlet in fluid communication with the inlet and configured to produce from the spray head a water stream, a second outlet having a fluid contact surface and in fluid communication with the inlet, a center longitudinal axis extending axially through the first outlet and the second outlet, the fluid contact surface extending in laterally spaced relation around the center longitudinal axis, the cartridge further including a deflector configured to redirect and decrease turbulence in water moving toward the second outlet and provide a substantially uniform water flow to the fluid contact surface, wherein the water from the second outlet is configured to produce a continuous shield of water extending outwardly from the spray head in a layer spaced apart from the water stream;

wherein the inlet is configured to be in simultaneous fluid communication with the first outlet and the second outlet; and a whirl member upstream from the deflector and configured to impart rotational movement to water passing from the inlet to the second outlet, wherein water from the second outlet rotates about the center longitudinal axis.

2. The spray head of claim 1, wherein the water stream produced by the first outlet has a substantially laminar flow.

3. The spray head of claim 1, wherein the second outlet has an outwardly flared surface which shapes the continuous shield of water to be conical.

4. The spray head of claim 3, wherein the second outlet is continuous and surrounds the first outlet.

5. The spray head of claim 1, wherein the spray head is a swivel spray head.

6. The spray head of claim 1, further comprising a spout base member, the spray head being coupled to the spout base member.

7. The spray head of claim 6, wherein the spray head is a pull out portion moveable between a first position coupled to the spout base member and a second position spaced apart from the spout base member.

8. The spray head of claim 1, further comprising a valve upstream from the fluid port, a spout in fluid communication with the valve and coupled to a sink deck, and wherein the body is a side spray configured to be coupled to the sink deck in spaced relation to the spout.

9. The spray head of claim 1, wherein the whirl member includes an annular body having a plurality of slots formed therein to rotate water outwardly about a longitudinal axis of the first outlet.

10. The spray head of claim 1, wherein the continuous shield of water surrounds the water stream.

11. The spray head of claim 1, further comprising a reflector cooperating with the whirl member and positioned upstream from the fluid contact surface, the reflector configured to change the direction of water supplied from the whirl member to the fluid contact surface.

12. The spray head of claim 1, wherein the first outlet does not extend axially beyond the second outlet.

13. A spray head for use with a water delivery system comprising:

a body including a fluid port configured to be coupled to a water supply;

a cartridge received within the body, the cartridge including an inlet in fluid communication with the fluid port, a first outlet in fluid communication with the inlet and configured to produce from the spray head a water stream, a second outlet having a fluid contact surface and in fluid communication with the inlet, a center longitudinal axis extending axially through the first outlet and the second outlet, the fluid contact surface extending in laterally spaced relation around the center longitudinal axis, the cartridge further including a deflector configured to redirect and decrease turbulence in water moving toward the second outlet and provide a substantially uniform water flow to the fluid contact surface, wherein the water from the second outlet is configured to produce a continuous shield of water extending outwardly from the spray head in a layer spaced apart from the water stream;

a whirl member upstream from the deflector and configured to impart rotational movement to water passing from the inlet to the second outlet, wherein water from the second outlet rotates about the center longitudinal axis;

wherein the inlet is configured to be in simultaneous fluid communication with the first outlet and the second outlet;

a spout base member, the spray head being coupled to the spout base member; and wherein the spray head is a pull out portion moveable between a first position coupled to the spout base member and a second position spaced apart from the spout base member.

14. The spray head of claim 13, wherein the water stream produced by the first outlet has a substantially laminar flow.

15. The spray head of claim 13, wherein the second outlet has an outwardly flared surface which shapes the continuous shield of water to be conical.

16. The spray head of claim 15, wherein the second outlet is continuous and surrounds the first outlet.

17. The spray head of claim 13, wherein the whirl member includes an annular body having a plurality of slots formed therein to rotate water outwardly about a longitudinal axis of the first outlet.

18. The spray head of claim 13, wherein the continuous shield of water surrounds the water stream.

19. The sprayhead of claim 13, further comprising a reflector cooperating with the whirl member and positioned upstream from the fluid contact surface, the reflector configured to change the direction of water supplied from the whirl member to the fluid contact surface.

20. The spray head of claim 13, wherein the first outlet does not extend axially beyond the second outlet.

* * * * *